US006530366B2

(12) United States Patent
Geiger et al.

(10) Patent No.: US 6,530,366 B2
(45) Date of Patent: Mar. 11, 2003

(54) APPARATUS FOR GAS RECIRCULATION IN AN INTERNAL COMBUSTION ENGINE

(75) Inventors: Michael Geiger, Freiberg/Neckar (DE); Thomas Jessberger, Rutesheim (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/922,940

(22) Filed: Aug. 7, 2001

(65) Prior Publication Data

US 2002/0023629 A1 Feb. 28, 2002

(30) Foreign Application Priority Data

Aug. 7, 2000 (DE) ..... 200 13 534 U

(51) Int. Cl.[7] ..... F02M 25/07
(52) U.S. Cl. ..... 123/568.11; 123/572; 60/278
(58) Field of Search ..... 123/568.11, 568.12, 123/572, 573, 574; 60/605.2, 612, 278, 279

(56) References Cited

U.S. PATENT DOCUMENTS

| | | | | | |
|---|---|---|---|---|---|
| 4,258,687 | A | | 3/1981 | Mauch et al. | 123/568.12 |
| 4,267,812 | A | | 5/1981 | Aula et al. | 123/568.12 |
| 5,027,781 | A | * | 7/1991 | Lewis | 123/568.11 |
| 5,440,880 | A | * | 8/1995 | Ceynow et al. | 123/568.12 |
| 5,592,925 | A | * | 1/1997 | Machida et al. | 123/568.11 |
| 5,806,308 | A | * | 9/1998 | Khair et al. | 123/568.12 |
| 5,911,213 | A | * | 6/1999 | Ahlborn et al. | 123/572 |
| 6,062,026 | A | * | 5/2000 | Woollenweber et al. | 60/612 |
| 6,301,887 | B1 | * | 10/2001 | Gorel et al. | 60/605.2 |

FOREIGN PATENT DOCUMENTS

| | | |
|---|---|---|
| GB | 2062749 | 5/1981 |
| JP | 3034971 | 5/1981 |

* cited by examiner

*Primary Examiner*—Willis R. Wolfe
(74) *Attorney, Agent, or Firm*—Crowell & Moring LLP

(57) ABSTRACT

An apparatus for gas recirculation in an internal combustion engine in which recirculation is effected via a connecting line (2) in which a filter element (4) is arranged between the exhaust duct and the connection on the intake device of the internal combustion engine.

16 Claims, 5 Drawing Sheets

APPARATUS FOR GAS RECIRCULATION IN AN INTERNAL COMBUSTION ENGINE

BACKGROUND OF THE INVENTION

The invention relates to an apparatus for gas recirculation in an internal combustion engine, particularly exhaust gas or the gas of a crankcase ventilator.

It is known, for instance, from U.S. Pat. Nos. 4,258,687 and 4,267,812 (=DE 30 34 971) that exhaust gases of an internal combustion engine can be recirculated from the exhaust pipe to the intake duct of the internal combustion engine. In these known arrangements, the recirculated exhaust gases are fed into the intake pipe without filtering. This is not a problem at relatively low recirculation rates. However, at high recirculation rates of 40–50%, which are necessary, for instance, in internal combustion engines with direct injection, there is such a pronounced amount of soot that a substantial accumulation of dirt in the intake pipe has to be expected.

Particularly a combined application of exhaust gas recirculation and gas supply from a crankcase ventilator (so-called blow-by) has the disadvantage of producing a sticky and tightly adhering mass of dirt. These deposits along the walls of the intake pipe reduce the flow cross sections. Furthermore, if the gases are introduced into switchable intake pipes in front of the switching elements, deposits on the switching elements will adversely affect their switching and/or sealing function. Deposits on the intake valves can also impair function.

SUMMARY OF THE INVENTION

It is the object of the invention to provide an apparatus for recirculating exhaust gases in which significant dirt accumulations are avoided.

This and other objects of the invention are achieved by providing an apparatus for gas recirculation in an internal combustion engine comprising a connecting line leading from a recirculation gas source to a connection to the intake device of the engine, wherein a filter element is arranged in the connecting line between the recirculation gas source and the connection to the intake device of the internal combustion engine. The recirculation gas source may be, for example, an internal combustion engine exhaust line or an internal combustion engine crankcase ventilator.

In a first embodiment of the invention, the gas recirculation apparatus is advantageously designed in such a way that a filter element is arranged in the connecting line between the exhaust pipe and the connection on the intake device of the internal combustion engine.

According to a second embodiment, a filter element is likewise advantageously arranged in the connecting line between the connection of a crankcase ventilator and the connection on the intake device of the internal combustion engine.

Connecting the filter according to the invention in the incoming line makes it readily possible to remove the soot from the recirculated gas so that, for instance, only the hot exhaust gas is supplied to the internal combustion engine or to the intake duct. The filter is preferably provided with a highly heat-resistant filter medium, such as a pressed part made of a high-grade steel. Due to a possibly high dirt accumulation, the filter element could be replaced at the same interval as the air filter, which has to be monitored in any case.

According to one advantageous embodiment, the filter element can be configured as an inline filter or, for assembly reasons, it can also be integrated into the exhaust gas recirculation flange of the intake pipe.

In accordance with another advantageous embodiment of the invention, a cyclone separator can be connected upstream of the filter element. This cyclone separator removes coarse soot particles and thus helps increase the service life of the filter element. It is of course also possible to use a cyclone separator as the filter element without providing an additional filter. In this case it is advantageous to use a multi-cell cyclone separator with high collection efficiency.

In yet another advantageous embodiment of the invention, cleaning is effected by electrical energy. At regular intervals, the filter medium is heated to above the burning temperature of the soot by applying an electrical voltage, and the soot is burned. The combustion gases can be fed into the exhaust gas duct of the internal combustion engine via a corresponding line.

An additional alternative to the interposition of a filter element is the use of an electrostatic separator. Such a separator is highly efficient and has a low $\Delta p$. The electrostatic separator can also be cleaned by heating.

A further embodiment of the invention involves the use of an easily replaceable filter as the filter element. To simplify the replacement of the filter element within a certain maintenance cycle, the filter element is arranged in an easy-change filter that can be unscrewed. This easy-change filter resembles an easy-change oil filter and can be readily disposed of, for instance by incineration.

These and other features of preferred embodiments of the invention, in addition to being set forth in the claims, are also disclosed in the specification and/or in the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
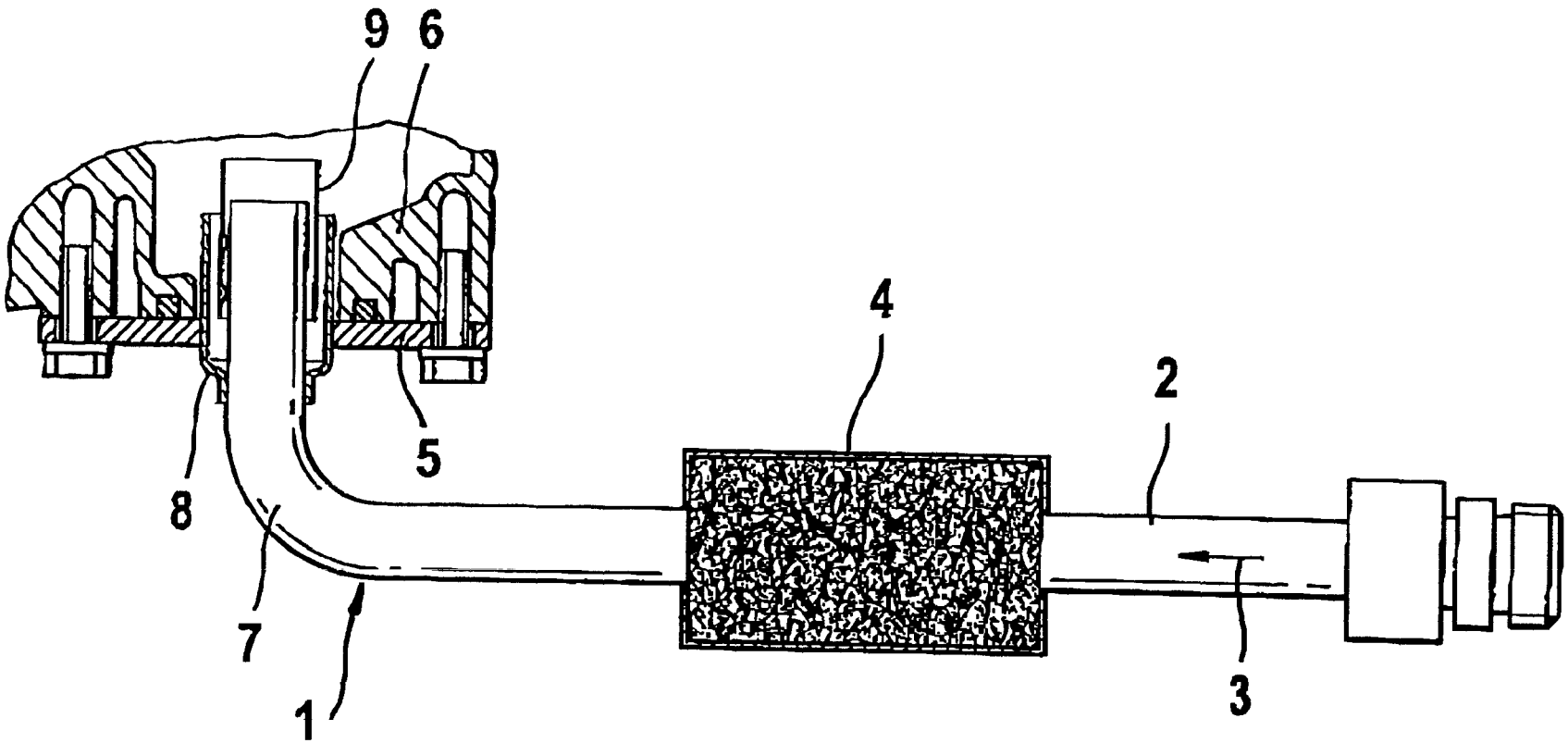
FIG. 1 is a cross section through an apparatus according to the invention.

FIG. 1 shows a cross section through a device 1 for cooling exhaust gas with gas recirculation 2 for an internal combustion engine (not shown) The exhaust gas flows into the recirculation system 3 as indicated by the arrow, through a filter element 4 to a connecting flange 5 on the intake device 6 of the internal combustion engine.

Filter element 4 removes the exhaust soot from the recirculated gas and supplies only filtered, hot exhaust gas to the internal combustion engine or the intake pipe. The filter medium of filter element 4 is made of a highly heat-resistant material. In a particularly preferred embodiment, the filter medium comprises a pressed part of high-grade steel and is configured as an inline filter.

According to another advantageous embodiment, the filter element can also be integrated into the exhaust gas recirculation flange of the intake pipe. The above-described filter element 4 can also be arranged in the gas supply of a crankcase ventilator.

The connecting flange 5 according to FIG. 1 is thermally insulated and arranged on the intake device 6. To this end, the exhaust gas recirculation pipe 7 is provided with a sleeve 8. This sleeve contacts the connecting flange 5. In the outlet area of the pipe, between sleeve 8 and the exhaust gas recirculation pipe, an additional sleeve 9 is provided, which is essentially thermally decoupled from the exhaust gas recirculation pipe 7. Thus, the exiting exhaust gas flows into the intake air plenum without heating the immediate environment of the intake device 6.

Figure 2:
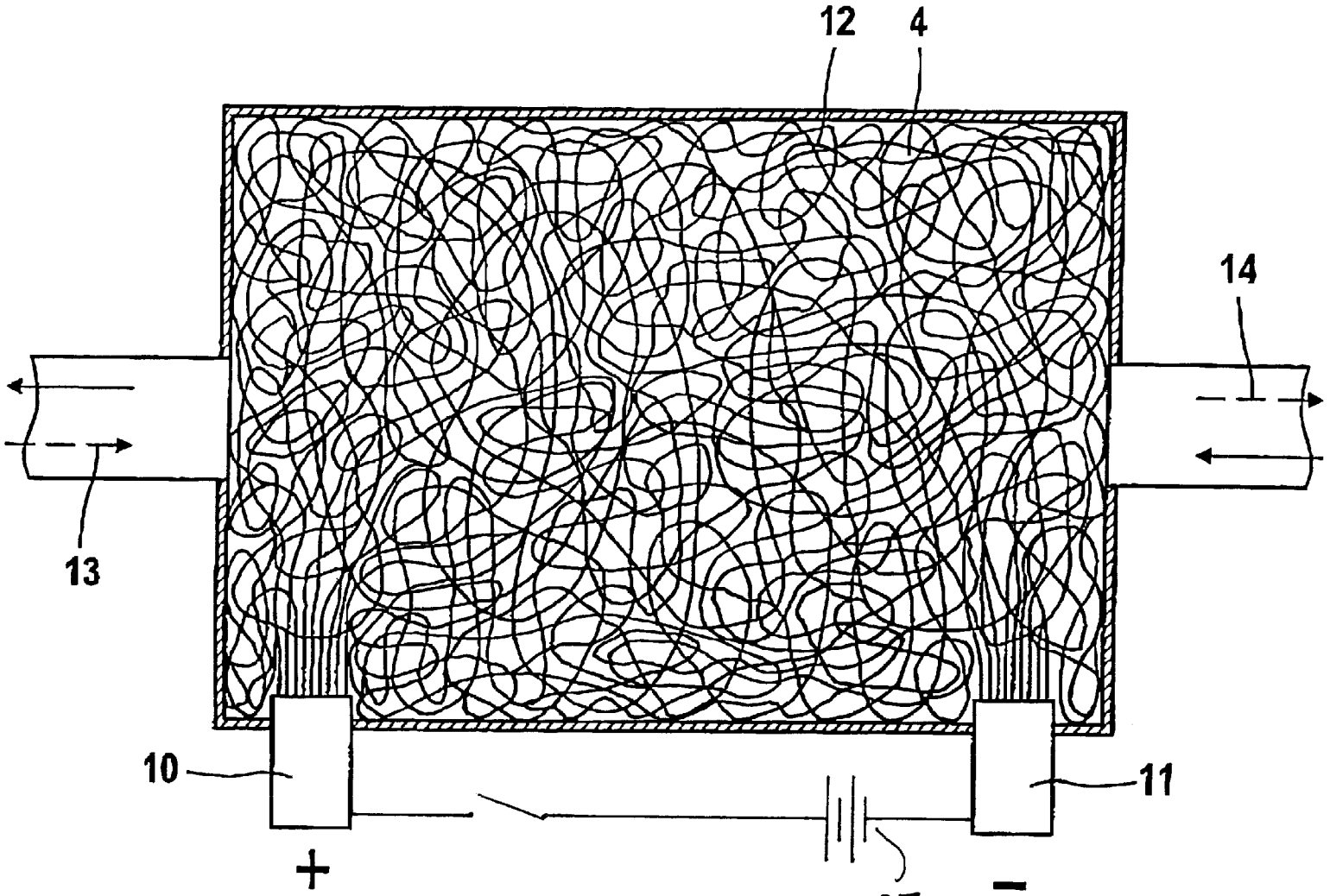
FIG. 2 is a schematic view of a cleanable filter element.

FIG. 2 shows a cleanable filter element 4 comprised of a steel mesh 5 in which the soot particles of the exhaust gas are deposited. To clean the steel mesh 12, the mesh is connected to a voltage source 27 via connections 10 and 11. When an electrical voltage is applied to these connections, the steel mesh 12 is heated to above the ignition temperature of the deposited soot. The soot is burned off and the resulting combustion gases are fed into the exhaust gas of the internal combustion engine via a change in the flow direction and a flow as indicated by arrows 13, 14.

Figure 3A:
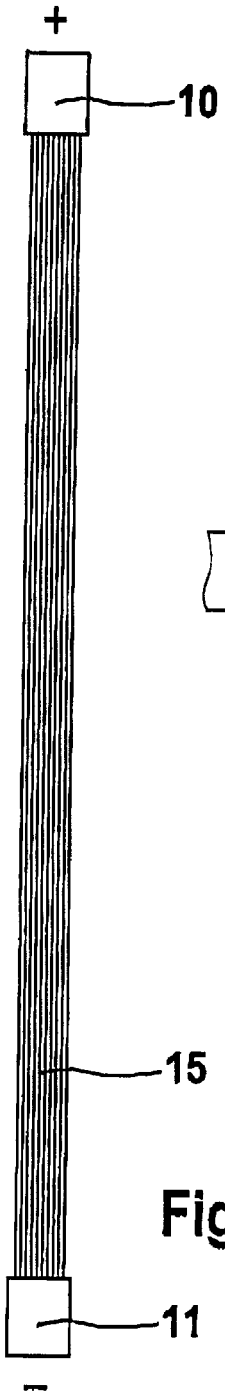
FIG. 3*a* is view of a filter element in its initial state.
Figure 3B:
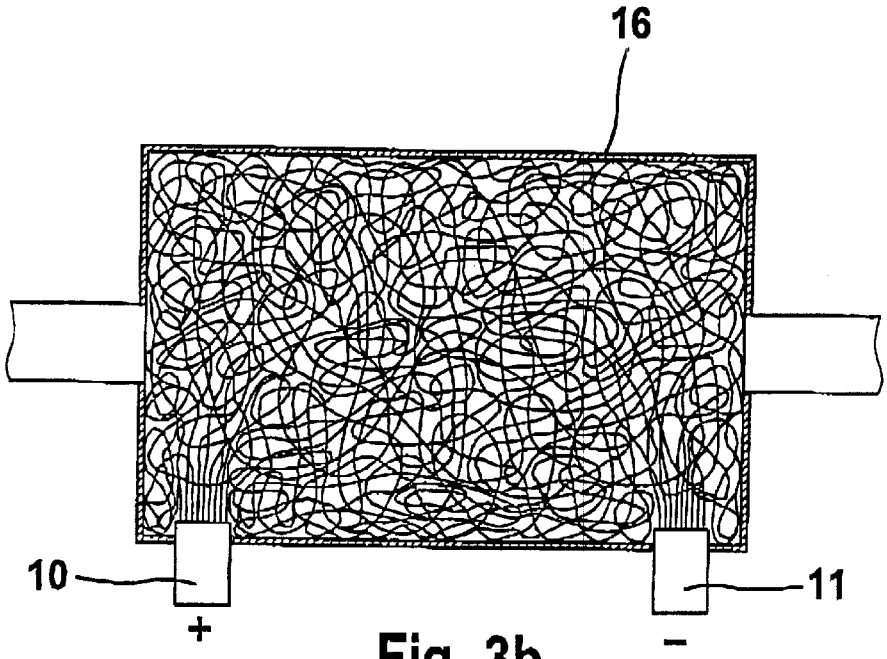
FIG. 3*b* shows the filter element of FIG. 3*a* in the installed state.

FIG. 3*a* illustrates the construction of filter element 4, made for instance of a steel mesh. Initially, it is a wire conductor 15 comprising a plurality of individual wires with electrical connections 10 and 11. This wire conductor is disposed in housing 16 of the filter element and the housing is sealed. The wire conductor can be readily removed from the housing for maintenance and a new wire conductor can be inserted without difficulty (FIG. 3*b*).

Figure 4A:
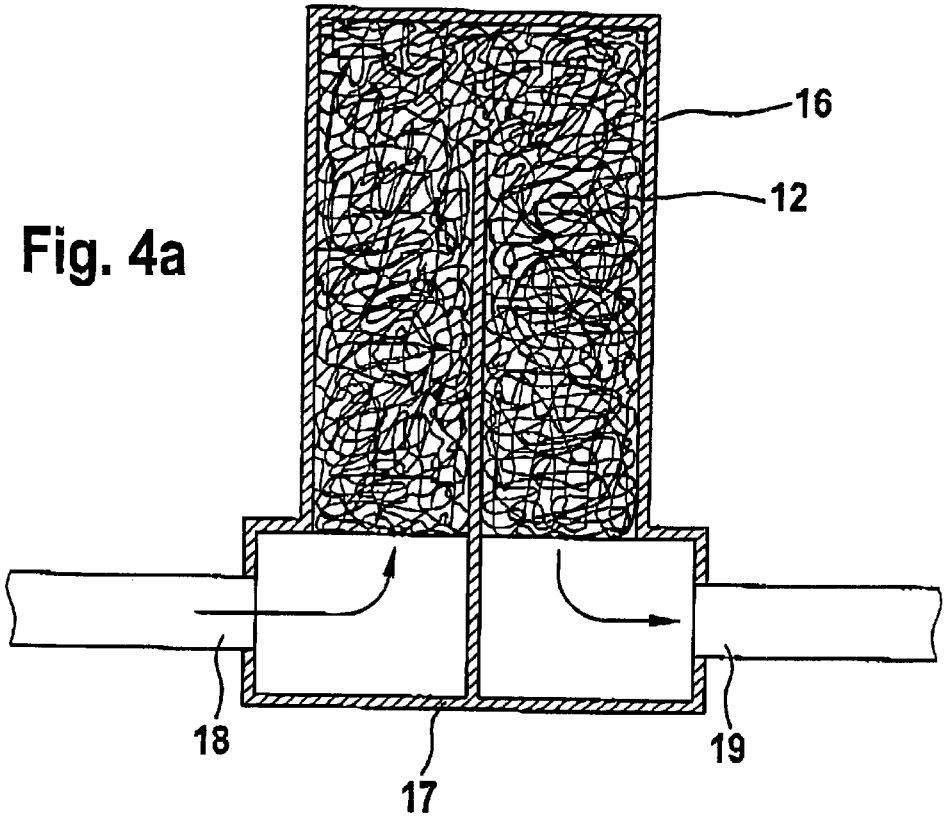
FIG. 4*a* is a view of a filter designed for easy replacement.

FIG. 4*a* schematically illustrates an easily replaceable filter in which a steel mesh 12 is arranged. This easy-change filter 16 is mounted to a filter head 17 to which the inlet 18 and the outlet 19 for the exhaust gas are connected.

Figure 4B:
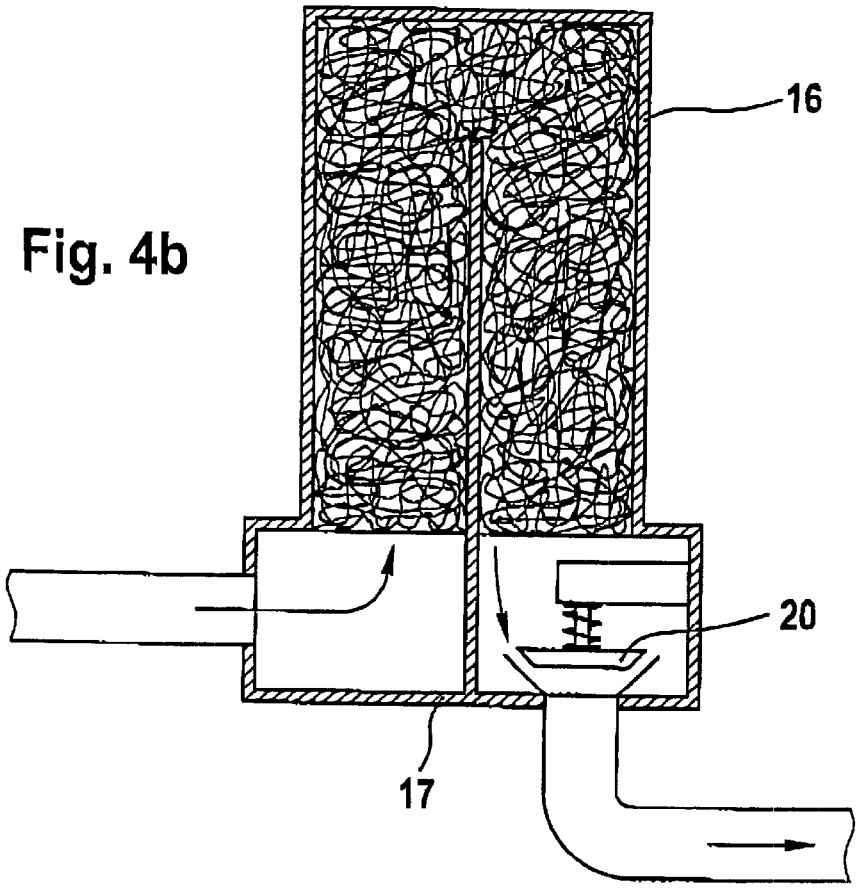
FIG. 4*b* is a view of another easily replaceable filter embodiment.

FIG. 4*b* also schematically shows an easy-change filter 16, but in addition to the connections for the inlet and the outlet of the exhaust gas, an exhaust gas recirculation valve 20 is provided in filter head 17, which controls the supply of the exhaust gas to the intake device. This exhaust gas recirculation valve 20 is arranged on the clean side of the filter element, so that dirt accumulation on the valve is prevented.

Figure 5:
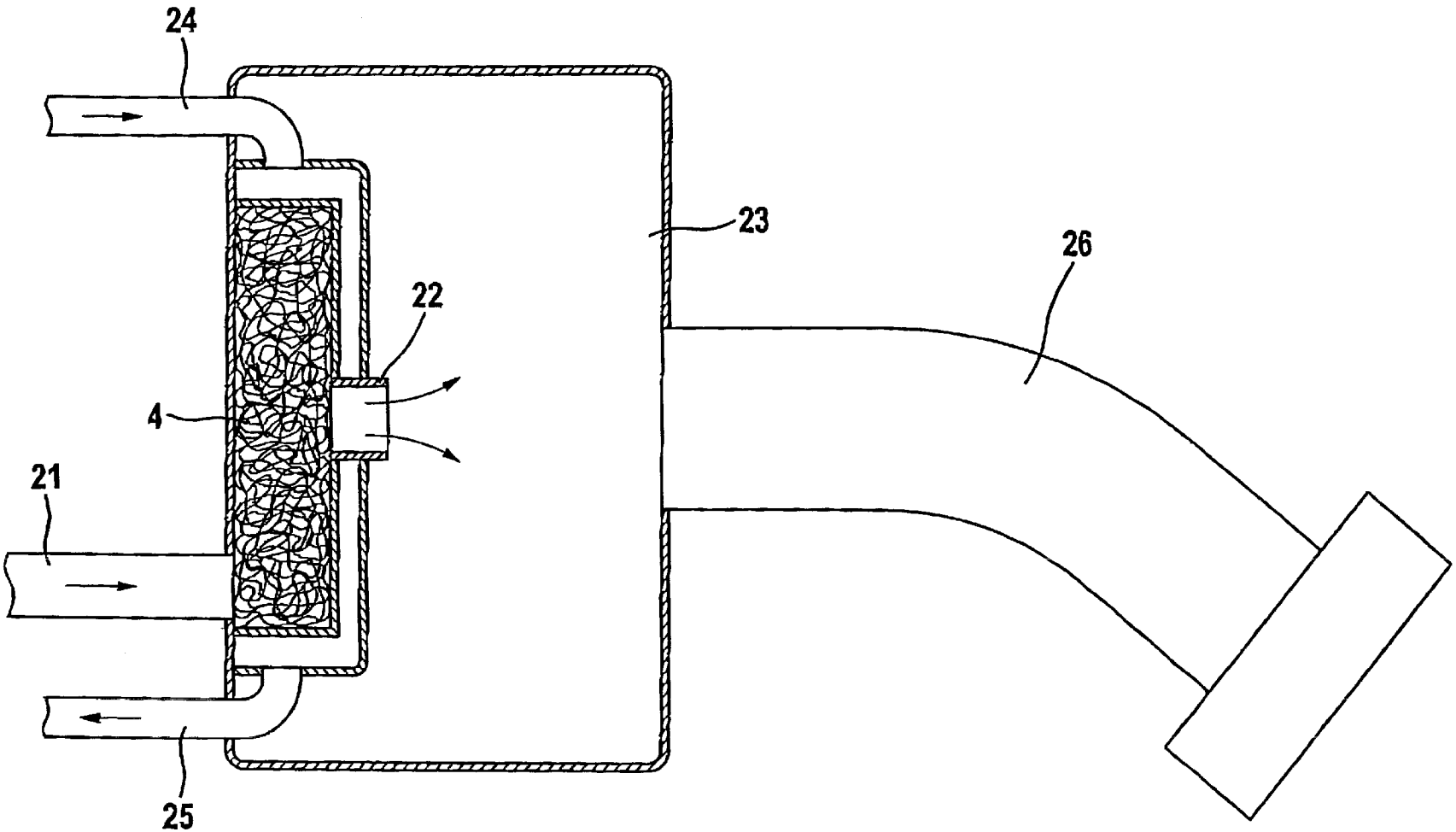
FIG. 5 is a cooling device for exhaust gas recirculation (EGR).

FIG. 5 shows a cooling device for exhaust gas recirculation. The exhaust gas is supplied to the filter element 4 via line 21 and after filtering flows through the exhaust gas recirculation pipe connection 22 into the intake plenum 23. To cool the recirculated exhaust gas, cooling water connections 24, 25 are provided. The cooling water flows around filter element 4 and ensures a constant exit temperature of the exhaust gas flowing into the intake pipe plenum 23. The intake air, which is mixed with exhaust gas reaches the internal combustion engine (not shown) via the intake flange 26.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. An apparatus for gas recirculation in an internal combustion engine comprising a connecting line leading from a recirculation gas source to a connection to the intake device of the engine, wherein a filter element is arranged in said connecting line between the recirculation gas source and the connection to the intake device of the internal combustion engine, wherein said filter element comprises a readily replaceable filter and wherein said filter is integrated in an engine air intake duct.

2. An apparatus according to claim 1, wherein said recirculation gas source is an exhaust pipe of the internal combustion engine.

3. An apparatus according to claim 1, wherein said recirculation gas source is a crankcase ventilator for the internal combustion engine.

4. An apparatus according to claim 1, wherein the filter element is arranged in the connecting line as an inline filter.

5. An apparatus according to claim 1, wherein the filter element is arranged in a connecting flange of the intake device of the internal combustion engine.

6. An apparatus according to claim 1, wherein said filter element comprises an electrostatic separator.

7. An apparatus according to claim 1, wherein said filter element comprises at least one cyclone separator.

8. An apparatus according to claim 7, wherein said filter element comprises a series of cyclone separator cells.

9. An apparatus according to claim 1, wherein said filter element comprises a readily replaceable filter.

10. An apparatus according to claim 9, wherein said filter is integrated in an exhaust gas recirculation valve.

11. An apparatus according to claim 1, wherein said filter element comprises a heat-resistant filter medium.

12. An apparatus according to claim 11, wherein said heat-resistant filter medium is selected from the group consisting of pressed parts made of high-grade steel, ceramic fiber filters, pressed parts made of glass fibers, and pressed parts made of mineral fibers.

13. An apparatus according to claim 11, further comprising an electrical energy supply for periodically heating the heat-resistant medium to a temperature above the burning temperature of soot to clean the filter element and increase the service life of the filter.

14. An apparatus according to claim 1, further comprising a particle separator arranged upstream from the filter element.

15. An apparatus according to claim 14, wherein said particle separator comprises at least one cyclone separator.

16. An apparatus according to claim 15, wherein said particle separator comprises a series of cyclone separator cells.

* * * * *